US010549899B2

(12) United States Patent
Huffer

(10) Patent No.: US 10,549,899 B2
(45) Date of Patent: Feb. 4, 2020

(54) RETORTABLE SELF-HEATING FOOD CONTAINER WITH AIR ACCESS STRUCTURE

(71) Applicant: SONOCO DEVELOPMENT, INC., Hartsville, SC (US)

(72) Inventor: Scott William Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 546 days.

(21) Appl. No.: 14/689,118

(22) Filed: Apr. 17, 2015

(65) Prior Publication Data

US 2016/0304266 A1 Oct. 20, 2016

(51) Int. Cl.
*B65D 81/34* (2006.01)

(52) U.S. Cl.
CPC ..... *B65D 81/3484* (2013.01)

(58) Field of Classification Search
CPC ..... B65D 81/3484; B65D 2205/025; B32B 2439/70; B32B 27/08; B32B 27/36; B32B 27/32; B32B 2307/31; B32B 27/306; B32B 27/34; B32B 7/12; B32B 15/08; B32B 15/09; B32B 2255/10; B32B 2307/7244; B32B 2439/40; B32B 15/18
USPC .... 428/516, 220, 35.2, 35.7, 34.9, 483, 213, 428/515, 137, 138, 480, 500, 212, 349, 428/518, 36.6, 910, 167, 520, 198, 411.1, 428/474.4, 172, 319.7, 34.2, 475.2, 521, 428/523, 131, 332, 476.1, 522, 166, 428/195.1, 209, 216, 221, 314.4, 318.6, 428/339, 35.9, 36.7, 421, 422, 457, 475.8, 428/182, 218, 35.8, 36.4, 36.91, 408, 428/40.1, 423.1, 423.7, 424.4, 43, 458, 428/473.5, 476.3, 511, 116, 174, 201, 428/299.1, 304.4, 316.6, 319.3, 343, 34.1, 428/355 EP, 35.4, 424.6, 424.8, 517, 688, 428/702, 132, 136, 141, 152, 188, 192, 428/215, 297.4, 301.1, 317.7, 318; 383/103, 109, 114, 116, 120, 200; 128/403; 62/4, 530
See application file for complete search history.

(56) References Cited

U.S. PATENT DOCUMENTS

| | | | | |
|---|---|---|---|---|
| 3,287,140 | A | 11/1966 | Brussell | |
| 5,180,599 | A * | 1/1993 | Feldmeier | B65D 75/5855 156/247 |
| 5,465,707 | A | 11/1995 | Fulcher et al. | |
| 6,289,889 | B1 | 9/2001 | Bell et al. | |
| 6,644,383 | B2 | 1/2003 | Joseph et al. | |
| 8,039,070 | B1 * | 10/2011 | Sawall | B32B 7/06 426/243 |
| 8,397,914 | B1 | 3/2013 | Janichek, Jr. et al. | |
| 8,545,099 | B2 | 3/2013 | Davis et al. | |

(Continued)

FOREIGN PATENT DOCUMENTS

WO 2012008064 A1 1/2012

*Primary Examiner* — Gerard Higgins
*Assistant Examiner* — Kevin C Ortman, Jr.
(74) *Attorney, Agent, or Firm* — Miller, Matthias & Hull LLP

(57) ABSTRACT

A flexible, self-heating food container capable of withstanding high temperatures is provided. The container comprises a two-layer laminate structure having an air access flap that can be lifted by the consumer to allow air to enter the part of the container where an exothermic reaction takes place.

14 Claims, 2 Drawing Sheets

(56) References Cited

U.S. PATENT DOCUMENTS

| | | | | |
|---|---|---|---|---|
| 9,024,360 | B1 | 5/2015 | Huffer et al. | |
| 9,850,056 | B2 | 12/2017 | Shaw et al. | |
| 2008/0128431 | A1* | 6/2008 | Gradzewicz ..... | B65D 75/5838 220/592.01 |
| 2009/0297745 | A1* | 12/2009 | Karsten ..... | C08L 23/10 428/35.7 |
| 2011/0103718 | A1 | 5/2011 | Bosman | |

* cited by examiner

RETORTABLE SELF-HEATING FOOD CONTAINER WITH AIR ACCESS STRUCTURE

BACKGROUND OF THE INVENTION

1. Field of the Invention

This invention patent relates to a self-heating food container. More particularly, this invention relates to a flexible, self-heating food container featuring a single use air access flap and capable of withstanding high (retort) temperatures.

2. Description of the Related Art

Flexible laminate packaging can be used as an alternative to cans to hold liquids and other consumables. The packages can be filled hot or the contents can be sterilized by retorting. Retorting typically involves heating the contents to 240-250 degrees for several minutes to kill microorganisms inside the package. The laminated film acts as an air and oxygen barrier to keep the contents fresh.

Self-heating packages are packages that can heat the contents without the use of an external heating means. One type of self-heating package uses an exothermic chemical reaction to heat the package contents. Self-heating packages may have a compartment for holding the consumable contents and one or more separate compartments for holding the chemical reagent(s) needed for the exothermic reaction that heats the contents. If the exothermic reaction requires oxygen, the package must include means for allowing air to enter the reaction space.

One means to introduce air into a self-heating package is the use of a flap that, when lifted or otherwise removed, exposes the interior to air. Thus there exists a need for a one-time opening feature in a retortable, self-heating package for allowing air access to activate the chemical component(s) for self-heating purposes. The present disclosure addresses this need.

BRIEF SUMMARY OF THE INVENTION

The present invention is a flexible, self-heating food package capable of withstanding high temperatures. The package comprises a two-layer laminate structure having an air access flap that can be lifted by the consumer to allow air to enter the part of the package where an exothermic reaction takes place.

In one aspect, the package comprises a flexible laminate film having a bottom layer and a top layer substantially coextensive with and laminated to the bottom layer.

The bottom layer comprises a substrate and a continuous resinous frangible skin layer located on an outer facing surface of the substrate between the substrate and the top layer. The bottom layer is precision scored to form one or more undercuts, each undercut defining a die cut section or plug. The top layer is precision scored to form an overcut which defines a periphery of a flap. The frangible skin layer is located within the flap periphery and may be located outside the flap periphery.

When the flap is lifted, the top layer separates from the bottom layer and simultaneously pulls out the die cut sections, creating the air holes in the bottom layer through which air can pass.

DETAILED DESCRIPTION OF THE INVENTION

Figure 1:
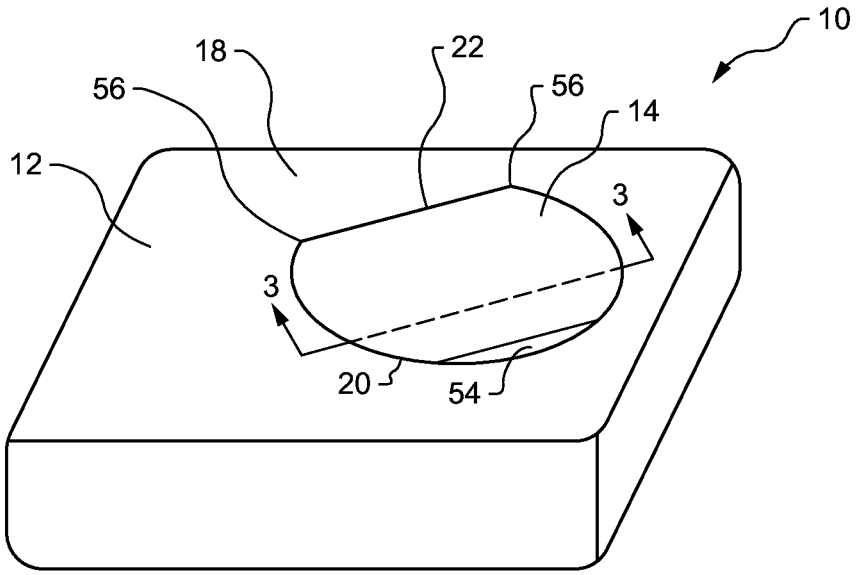
FIG. 1 is a perspective view of a flexible self-heating package according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIG. 1 a flexible package 10 according to the disclosure. The package 10 is made from a two-layer laminate film 12 and has an air access flap 14 that can be lifted by the consumer to allow air to enter a compartment where an exothermic reaction takes place. The laminate film 12 acts as an air and oxygen barrier to keep the contents fresh.

The laminate film 12, described in more detail below with respect to FIGS. 3 and 4, comprises a bottom layer 16 and a top layer 18 bonded together with a permanent adhesive 34. The top layer 18 is precision scored to form an overcut 20 which defines the periphery 20 of the flap 14. In FIG. 1 the flap 14 is substantially semi-circular and is attached to the rest of the package 10 along a hinge line 22, although the flap 14 may be any suitable shape.

The package 10 can be used to hold food that requires heating before being consumed. The package 10 may have multiple internal compartments, including one or more for food (not shown in the figures) and one or more for the chemical reagents (aka heating agents) that cause the exothermic reaction when exposed to air. After the contents and heating agents are placed within their respective compartments inside the flexible package 10, the package 10 is sealed shut. The sealing may be accomplished by crimping, folding or otherwise closing off the ends and then exposing the ends to a temperature sufficient to at least partially melt the film so that it fuses or welds together to form a heat seal if heat sealing is used. Alternatively, and without limitation, the ends may be sealed using cold sealing.

The package 10 can be filled hot, or the contents can be sterilized by retorting. Retorting typically involves heating the contents to 240-250 degrees for several minutes to kill microorganisms inside the package 10.

Figure 2:
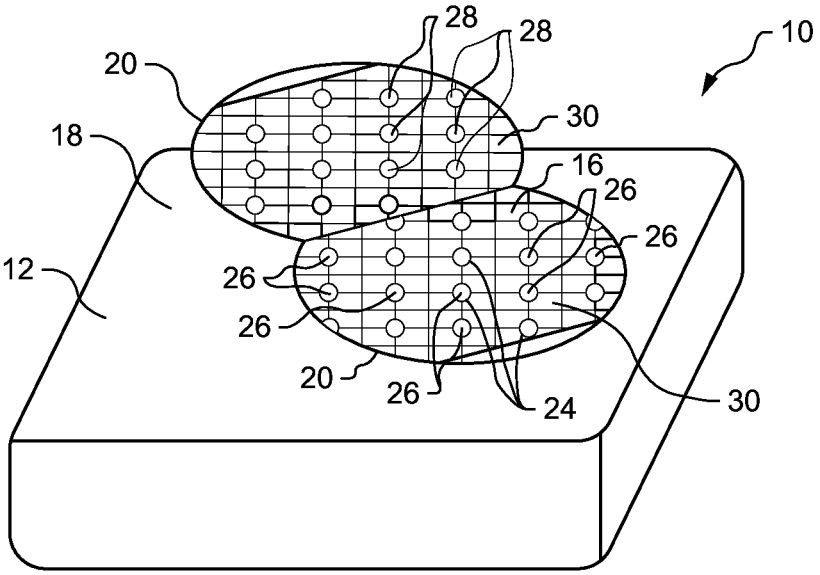
FIG. 2 is a perspective view of the package of FIG. 1 shown after a flap has been lifted to allow air flow into a compartment.

FIG. 2 is a perspective view of the package 10 of FIG. 1 shown after the flap 14 has been lifted to allow air flow into a compartment. The bottom layer 16 is exposed where the flap 14 has been lifted. The bottom layer 16 is precision scored at a number of locations to form undercuts 24 which will define air holes 26 when the flap 14 is lifted. The undercuts 24 may extend through both the substrate 16 and frangible skin layer 30 and optionally into the permanent adhesive 34, or just through the substrate 16. As explained more fully below, lifting the flap 14 causes plugs 28 to be removed from the bottom layer 16, creating the air holes 26 in the bottom layer 16. The air holes 26 communicate with the compartment(s) holding the chemical reagents.

The frangible skin layer 30, indicated in cross-hatching in FIG. 2, is located between the bottom layer 16 and the top layer 18. The frangible skin layer 30 may be a coextruded skin layer and may be bonded to the permanent adhesive 34 during the lamination process. This frangible skin layer 30 splits apart when the flap 14 is lifted from the bottom layer 16, leaving some of the frangible skin layer 30 affixed to both the flap 14 and the bottom layer 16. The frangible skin layer 30 preferably is limited to the area within the overcut 20. Outside this area the bottom layer 16 and the top layer 18 may be laminated together with the permanent adhesive 34.

The food or other contents may be accessed by lifting a second flap, not shown in the figures, which may also adhered to the bottom layer 16, or by opening the food compartment(s) by other means.

Figure 3:
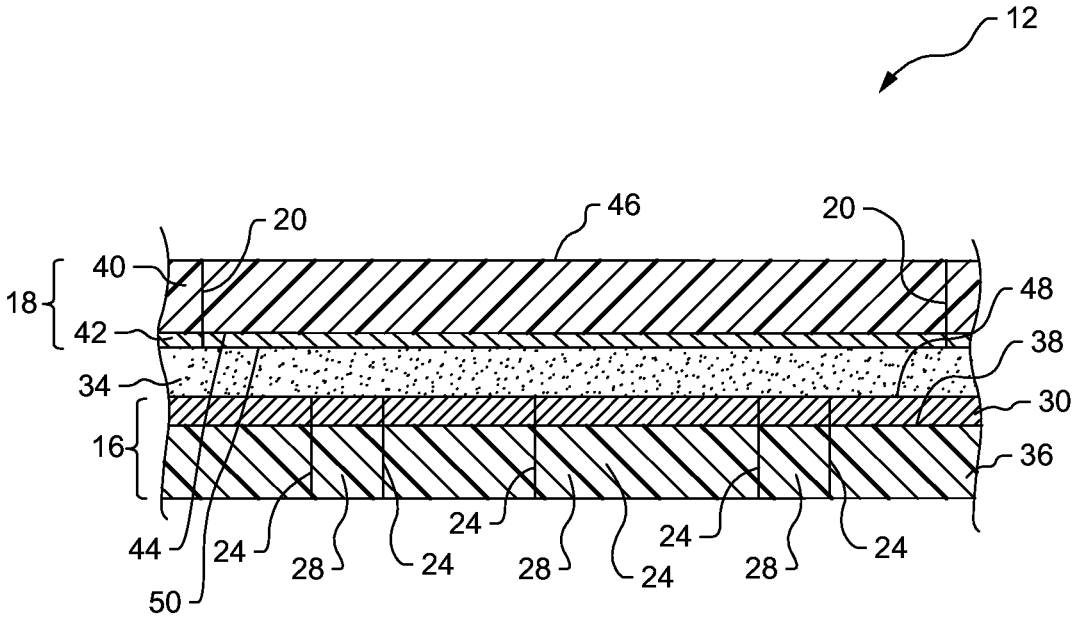
FIG. 3 is a cross-sectional view of the package of FIG. 1 taken along line 3-3.

FIG. 3 is a cross-sectional view of the package 10 of FIG. 1 taken along line 3-3, showing one embodiment of a robust two-ply laminate film 12 for use in making the retortable, self-heating package 10. The laminate film 12 comprises, from the inside out, a bottom layer 16, a heat seal or permanent adhesive 34 and a top layer 18.

The bottom layer 16 may comprise a substrate 36 and a coextruded frangible skin layer 30. The substrate 36 may be cast polypropylene (CPP), high density polyethylene (HDPE), low density polyethylene (LDPE), linear low density polyethylene (LLDPE) or any suitable material. The frangible skin layer 30 is coextruded onto an outer facing surface 38 of the substrate 16. The frangible skin layer 30 may be formed from a resinous material and a contaminant that weakens the resinous material in the Z-direction, that is, the direction orthogonal to the plane of the laminate film 12.

The coextruded bottom layer 16 is laminated to the top layer 18 by the permanent adhesive 34 so that the frangible skin layer 30 is interposed between the substrate 16 and the top layer 18. The permanent adhesive 34 may be a heat seal or any suitable adhesive, and may be continuous or pattern applied.

The top layer 18 may include a barrier layer 40 and an ink layer 42. The barrier layer 40 may be transparent metallized polyethylene terephthalate (PET) film and may act as an oxygen barrier. The barrier layer 40 has an inner facing surface 44 and an outer facing surface 46. The inner facing surface 44 of the barrier layer 40 may be treated so that it can accept the ink layer 42, preferably in the form of reverse printed graphics.

Still referring to FIG. 3, the bottom layer 16 is precision scored at a number of locations to form undercuts 24 which will define the air holes 26 when the flap 14 is lifted.

The frangible skin layer 30 does not significantly degrade upon exposure to retort temperatures. More specifically, the frangible skin layer 30 does not significantly degrade upon exposure to 240-250 degree temperatures for several minutes. This allows the package 10 to be subjected to retort temperatures within compromising the integrity of the air access flap 14.

Figure 4:
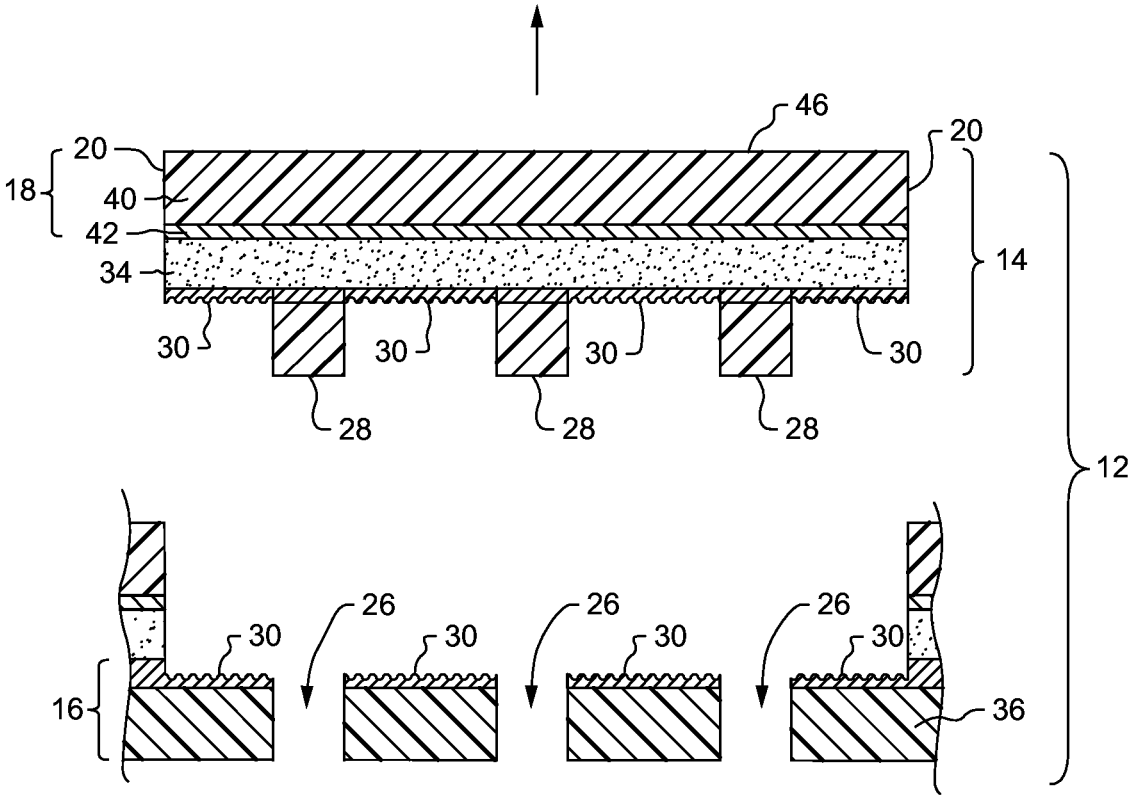
FIG. 4 is the same cross-sectional view as FIG. 3 but after the flap has been lifted.

FIG. 4 is cross-sectional view of FIG. 3 after the flap 14 has been lifted. When the flap 14 is lifted, the top layer 18 and permanent adhesive 34 separate from the substrate 36 at the peelable interface (frangible skin layer 30) and simultaneously pull out die cut sections (plugs) 28, creating the air holes 26 in the bottom layer 16 through which air can pass.

More specifically, when the flap 14 is lifted, the two-layer laminate film 12 will fail at the frangible skin layer 30 but remain intact within the areas defined by the undercuts 24 (and outside the overcut 20). The frangible skin layer 30 outside the areas defined by the undercuts 24 (and within the larger area defined by the overcut 20) splits, and may leave some of the frangible skin layer 30 on both the top layer 18 and the substrate 16. The intact portions of the laminate film 12 within the areas defined by the undercuts 24 include plugs 28 which have been lifted from the bottom layer 16. The coextruded bottom layer 16 remains as a continuous sheet except for the air holes 26 where the plugs 28 have been lifted away.

The peel-away air access flap 14 is a one-time use feature because the frangible skin layer 30, once split apart, does not adhere well to itself. What is left after the flap 14 is peeled away is a bottom layer 16 with the flap 14 removed and air holes 26 exposed.

In another aspect of the disclosure a method of making a flexible self-heating package 10 is provided. The method may comprise the following steps:

A bottom layer 16 is made by coextruding a substrate 36 and a frangible skin layer 30.

An optional ink layer 42 may be applied to the inner facing surface 44 of the barrier layer 40.

The permanent adhesive 34 may be pattern applied onto the outer facing surface 48 of the bottom layer 16 or onto the inner facing surface 50 of the ink layer 42 or, if there is no ink layer 42, onto the inner facing surface 44 of the barrier layer 40. Preferably the permanent adhesive 34 does not cover a small area 52 of the bottom layer 16 which will be overlaid with a lift tab 54 (FIG. 2) so that the lift tab 54 is not adhered to the bottom layer 16. Typically the permanent adhesive 34 is not applied to a small area 52 within the overcut 20 adjacent the overcut 20 and opposite the hinge line 22.

Next, the "coex" or bottom layer 16 is adhered to the top layer 18 with the permanent adhesive 34 to produce the laminate film 12. This may be accomplished using a laminating machine comprising two rollers forming a nip therebetween. The bottom layer 16 and the top layer 18 should be substantially coextensive with each other during the laminating process. For example, if the layers 16, 18 are rectangular, the width and length of the bottom layer 16 should match the width and length of the top layer 18. The laminate 12 film may be rectangular or any shape suitable for forming the desired flexible package 10.

Next, a roll of the laminate film 12 is fed to a first scoring station where small, preferably circular undercuts 24 are scored in the bottom layer 16. The undercuts 24 may be formed with a laser, with a die cutting machine or by any suitable means and may extend through the entire thickness or almost the entire thickness of the bottom layer 16.

The roll of laminate film 12 is fed to a second scoring station where an overcut 20 is formed in an outer facing surface 46 of the barrier layer 40. The overcut 20 preferably is formed with a laser, with a die cutting machine or by any suitable means and may extend through the entire thickness or almost the entire thickness of the top layer 18.

The overcut 20 may be any suitable shape. In the illustrated example, the overcut 20 forms a semi-circle pattern surrounding the undercuts 24. The overcut 20 terminates in opposing ends 56 which form the ends 56 of a hinge line 22 along which the flap 14 is permanently affixed to the top layer 18. Alternatively, the overcut 20 may be a closed two-dimensional shape so that the flap 14 is completely removable from the package 10.

The laminate film 12 can now be rolled up for use in packaging products. For example and without limitation, the laminate film 12 can be used to wrap food or other contents that require heating. A heating agent may be placed in a first compartment sealed by the flap 14. After the food that requires heating is placed inside a second compartment within the flexible package 10, the package is sealed to create the filled package 10. In yet another aspect of the disclosure a method of using the flexible self-heating package 10 is provided comprising the steps of:

Lifting the flap 14 to expose the heating agents to air and thus start the exothermic reaction which heats the edible contents.

Opening the food compartment in any suitable manner, for example, by lifting another flap (not shown) or by opening an end of the package 10.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A package having a first compartment, the package comprising:

a flexible laminate film comprising a bottom layer bonded to a top layer with a permanent adhesive, the bottom layer and the top layer being substantially coextensive;

the bottom layer comprising a substrate and a continuous resinous frangible skin layer, wherein the frangible skin layer is disposed between the substrate and the permanent adhesive;

the top layer being precision scored to form an overcut which defines a periphery of a flap;

the substrate being precision scored to form one or more undercuts, each undercut defining a die cut section; wherein the frangible skin layer is in direct contact with the permanent adhesive and is located on an outer facing surface of the substrate between the substrate and the permanent adhesive and within the flap periphery such that the frangible skin layer connects the die cut sections of the substrate to the permanent adhesive; and wherein lifting the flap from the bottom layer removes the die cut sections from the bottom layer to create air holes in the bottom layer through which air can pass to the first compartment.

2. The package of claim 1 wherein:

the top layer is an air and oxygen barrier.

3. The package of claim 2 wherein:

the first compartment holds a chemical reagent that causes an exothermic reaction when exposed to air, the package further comprising a second compartment for holding food.

4. The package of claim 3 wherein:

the flap is attached to the top layer along a hinge line.

5. The package of claim 4 wherein:

the undercuts extend through the frangible skin layer but not the permanent adhesive.

6. The package of claim 5 wherein:

the frangible skin layer is a coextruded skin and is bonded to the permanent adhesive during a lamination process.

7. The package of claim 1 wherein:

the laminate film defines a plane; and the frangible skin layer comprises a resinous material and a contaminant that weakens the resinous material a direction orthogonal to the plane of the laminate film.

8. The package of claim 1 wherein:

the top layer comprises a barrier layer and an ink layer applied to an inner facing surface of the barrier layer.

9. The package of claim 1 wherein:

the frangible skin layer does not significantly degrade upon exposure to retort temperatures.

10. The package of claim 1 wherein:

the frangible skin layer does not significantly degrade upon exposure to 240-250 degree F. temperatures for several minutes.

11. The package of claim 1 wherein:

the frangible skin layer splits apart in areas that do not connect the die cut sections of the substrate to the permanent adhesive when the flap is lifted from the bottom layer, leaving some of the frangible skin layer affixed to both the flap and the bottom layer; and the frangible skin layer does not split apart in areas connecting the die cut sections of the substrate to the permanent adhesive when the flap is lifted such that the die cut sections are removed from the substrate to create air holes in the substrate.

12. The package of claim 1 wherein:

the overcut forms a pattern in substantial registration with the frangible skin layer.

13. The package of claim 12 wherein:

the overcut terminates in opposing ends which form the ends of a hinge line along which the flap is permanently affixed to the top layer.

14. The package of claim 12 wherein:

the overcut forms a closed two-dimensional shape so that the flap is completely removable from the package.

* * * * *